US008474100B2

(12) United States Patent
Vanini

(10) Patent No.: US 8,474,100 B2
(45) Date of Patent: Jul. 2, 2013

(54) COMBINATION OF A HINGE FOR DOORS OR WINGS AND A DAMPING DEVICE

(75) Inventor: Angelo Vanini, Bologna (IT)

(73) Assignee: NUOVA STAR S.p.A. (IT)

( * ) Notice: Subject to any disclaimer, the term of this patent is extended or adjusted under 35 U.S.C. 154(b) by 205 days.

(21) Appl. No.: 12/873,984

(22) Filed: Sep. 1, 2010

(65) Prior Publication Data

US 2011/0068671 A1 Mar. 24, 2011

(30) Foreign Application Priority Data

Sep. 23, 2009 (IT) ..... BO2009A0609

(51) Int. Cl.
*E05F 1/08* (2006.01)

(52) U.S. Cl.
USPC ..... 16/286; 16/50

(58) Field of Classification Search
USPC ..... 16/49–70, 286
See application file for complete search history.

(56) References Cited

U.S. PATENT DOCUMENTS

| | | | | |
|---|---|---|---|---|
| 3,712,287 | A | 1/1973 | Summers, Jr. | |
| 3,772,736 | A | 11/1973 | Hettich et al. | |
| 3,818,637 | A * | 6/1974 | Vivier | 49/379 |
| 3,955,865 | A | 5/1976 | Wilson | |
| 4,383,347 | A | 5/1983 | LaConte | |
| 4,422,214 | A | 12/1983 | Lautenschlager et al. | |
| 4,543,686 | A | 10/1985 | Rock et al. | |
| 4,817,240 | A | 4/1989 | Sovis et al. | |
| 5,075,923 | A * | 12/1991 | Taylor | 16/63 |
| 5,269,043 | A | 12/1993 | Yang | |
| 5,704,569 | A | 1/1998 | Daniels | |
| 6,684,453 | B2 | 2/2004 | Wang | |

(Continued)

FOREIGN PATENT DOCUMENTS

| | | |
|---|---|---|
| AT | 9711 | 2/2008 |
| DE | 4100877 | 7/1992 |

(Continued)

OTHER PUBLICATIONS

Search Report dated Mar. 25, 2010 from counterpart Italian patent application.

*Primary Examiner* — Victor Batson
*Assistant Examiner* — Matthew Sullivan
(74) *Attorney, Agent, or Firm* — Timothy J. Klima; Shuttleworth & Ingersoll, PLC

(57) ABSTRACT

Described is a combination of a hinge for doors or wings and a damping device in which the hinge (2) is composed of a first fastening arm (7), a second fastening arm (8) and a connecting system (9) interposed between the first and the second fastening arm (7, 8) in such manner as to make them reciprocally mobile; and in which the damping device (3) is associated with the hinge (2) at a mounting position where the damping device (3) and the hinge (2) are positioned close to each other; the damping device (3) comprises a mounting case (10), a cylinder and piston unit (11) hinged to the mounting case (10), an actuating rod (12) and a drive unit (13) interposed between the cylinder and piston unit (11) and the actuating rod (12) in order to impart to the piston (26) and cylinder (27) a relative sliding movement; the actuating rod (12) extends into the hinge (2) and is movable in a straight line between a first, extracted position, where it extends freely into the open hinge (2), and a second, retracted position, where it is in contact with a thrust surface (17) of the closed hinge (2).

18 Claims, 4 Drawing Sheets

U.S. PATENT DOCUMENTS

| | | | | |
|---|---|---|---|---|
| 6,789,293 | B2 | 9/2004 | Habegger et al. | |
| 7,600,295 | B2 | 10/2009 | Zimmer | |
| 7,748,080 | B2 * | 7/2010 | Hottmann | 16/72 |
| 2003/0200625 | A1 | 10/2003 | Zimmer | |
| 2004/0040118 | A1 | 3/2004 | Han et al. | |
| 2004/0205935 | A1 | 10/2004 | Lautenschlaeger et al. | |
| 2005/0015927 | A1 | 1/2005 | Kropf | |
| 2008/0168618 | A1 * | 7/2008 | Hottmann | 16/50 |
| 2008/0289144 | A1 * | 11/2008 | Vanini | 16/221 |
| 2010/0101052 | A1 | 4/2010 | Waltemate et al. | |
| 2011/0283478 | A1 * | 11/2011 | Berry et al. | 16/54 |

FOREIGN PATENT DOCUMENTS

| | | |
|---|---|---|
| DE | 19522254 | 1/1997 |
| EP | 50320 | 4/1982 |
| EP | 1217159 | 6/2002 |
| EP | 1884614 | 2/2008 |
| WO | 2008119647 | 10/2008 |

* cited by examiner

COMBINATION OF A HINGE FOR DOORS OR WINGS AND A DAMPING DEVICE

This application claims priority to Italian Patent Application BO2009A000609 filed Sep. 23, 2009, the entirety of which is incorporated by reference herein.

BACKGROUND OF THE INVENTION

This invention relates to a combination of a hinge for doors or wings and a damping device. More specifically, the hinge is designed to connect the door of an electrical household appliance, such as a refrigerator, to a respective mounting frame.

In customary refrigerators, which this specification specifically refers to but without thereby restricting the scope of the invention, the hinges normally comprise two fastening arms mounted on the outside, one on the door and the other on the refrigerator frame. The two fastening arms are hinged to each other directly or, more usually, through one or more interposed levers.

The hinges often have a built-in damping device designed to eliminate or at least significantly reduce the stresses and noise produced when the door is banged or slammed shut.

A solution of this kind is disclosed in patent application EP 1884614 A2, where a piston and cylinder unit is hinged, on one side, to the part of the hinge that is fixed to the frame and, on the other side, to the door of a refrigerator.

The damping device described in patent application EP 1884614 A2 is mounted on the outside of the hinge, making it not only dangerous but also unattractive since it is clearly in view when the door is open.

Another solution is known from patent application WO 2008/119647 A1. In that case, the piston and cylinder unit is mounted on the inside of the hinge but this makes the hinge mechanically complex and relatively expensive to manufacture.

In other prior art solutions, generally speaking, the damping device is applied as a separate component to a hinge of a door, wing or the like.

For example, German patent DE 19522254 C2 discloses a cylinder and piston unit mounted on a door frame in such a way that, when the door is opened, the free end of the piston is stretched forward to an extended position. That way, before the door reaches the closed position, it comes into contact with the free end of the piston, which compresses the air inside the cylinder, thereby slowing down the door.

This solution, too, is not free of disadvantages, however. In effect, the thrust which the piston receives from the door is not perfectly axial, producing stress on the damping device which, in the long run, may lead to faulty sliding of the piston in the cylinder. Moreover, the free end of the piston protrudes from a zone of the frame where it may easily and dangerously interfere with the movements of the user.

SUMMARY OF THE INVENTION

This invention therefore has for an aim to provide a combination of a hinge for doors or wings and a damping device that is free of the above mentioned disadvantages.

More specifically, the aim of this invention is to provide a combination of a hinge for doors or wings and a damping device that is effective, inexpensive and durable.

A further aim of this invention is to provide a combination of a hinge for doors or wings and a damping device that is easy to assemble.

A yet further aim of this invention is to provide a combination of a hinge for doors or wings and a damping device that is safe and aesthetically pleasing.

According to the invention, the above aims are achieved by a combination of a hinge for doors or wings and a damping device comprising the features described in one or more of the appended claims.

BRIEF DESCRIPTION OF THE DRAWINGS

The technical features of the invention, with reference to the above aims, are clearly described in the claims below and its advantages are more apparent from the detailed description which follows, with reference to the accompanying drawings which illustrate a preferred non-limiting example embodiment of the invention and in which:

DESCRIPTION OF THE PREFERRED EMBODIMENTS

Figure 1:
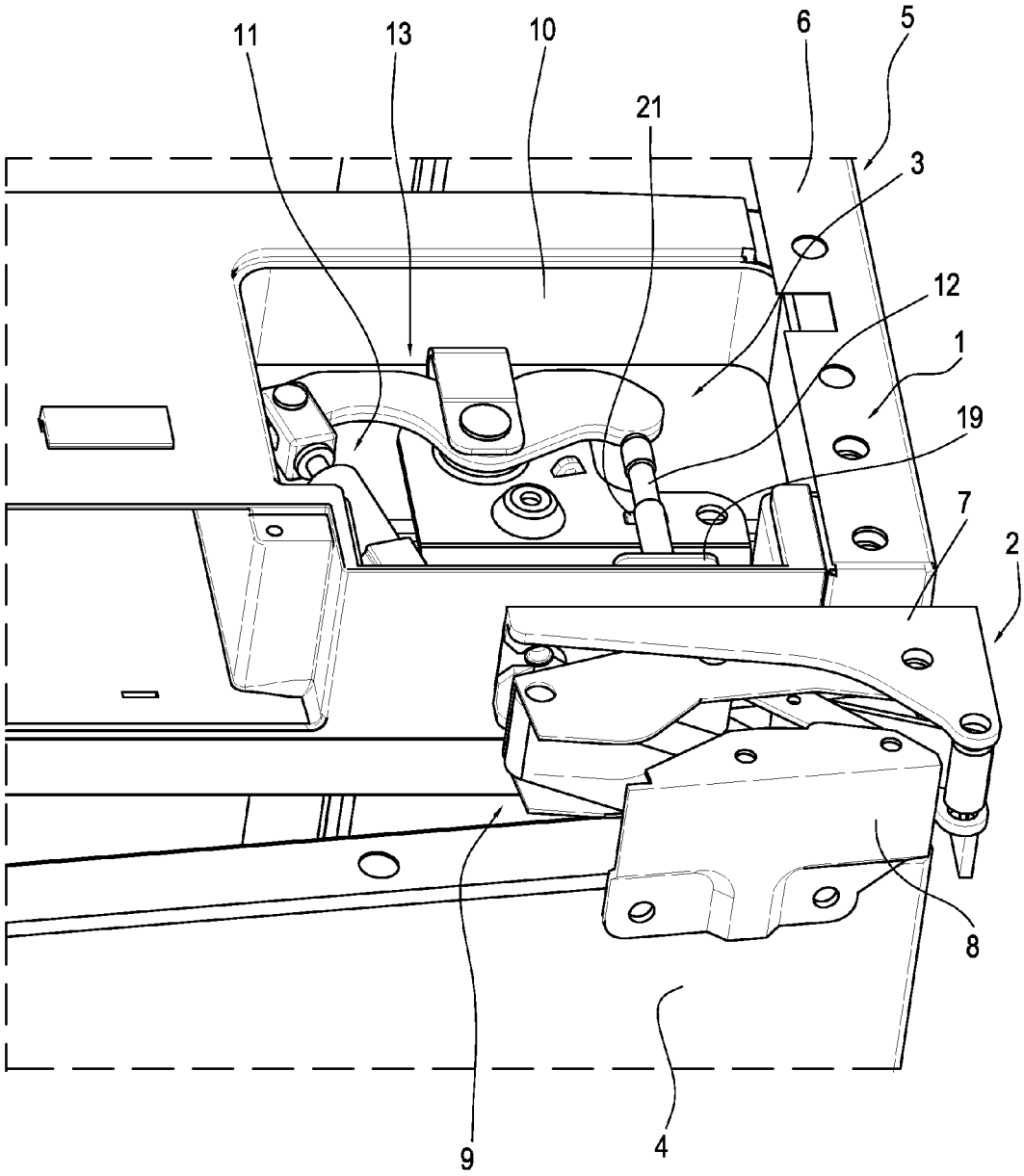
FIG. 1 is a perspective view showing a preferred embodiment, according to this invention, of a hinge for doors or wings and a damping device acting in conjunction with each other and mounted on a refrigerator.

The reference numeral 1 in FIG. 1 denotes in its entirety a combination of a hinge 2 for doors or wings and a damping device 3.

The hinge 2 connects the door 4 of a refrigerator 5 to a respective mounting frame 6. In this regard, it should be stressed that although the hinge 2 and the damping device 3 in the example illustrated are mounted on a refrigerator, the hinge 2 and the damping device 3 might, more in general, be mounted on any electrical household appliance or any wing and frame (or door and frame) system.

The damping device 3 acts in conjunction with the hinge 2 to eliminate or at least significantly reduce the stresses and noise produced when the door 4 of the refrigerator 5 is banged or slammed shut.

The hinge 2 comprises a first arm 7 fastened, for example screwed, to the outside of the frame 6, and a second arm 8 fastened, for example screwed, to the door 4.

The two fastening arms 7, 8 are hinged to each other through an interposed group of levers 9, in particular through a two-lever joint hinged at one end to the arm 7 and at the other end to the arm 8.

Alternatively, in an embodiment which is not illustrated but easy to infer from the context, the arms 7 and 8 may be hinged to each other directly by means of a cylindrical hinge.

Figure 4:
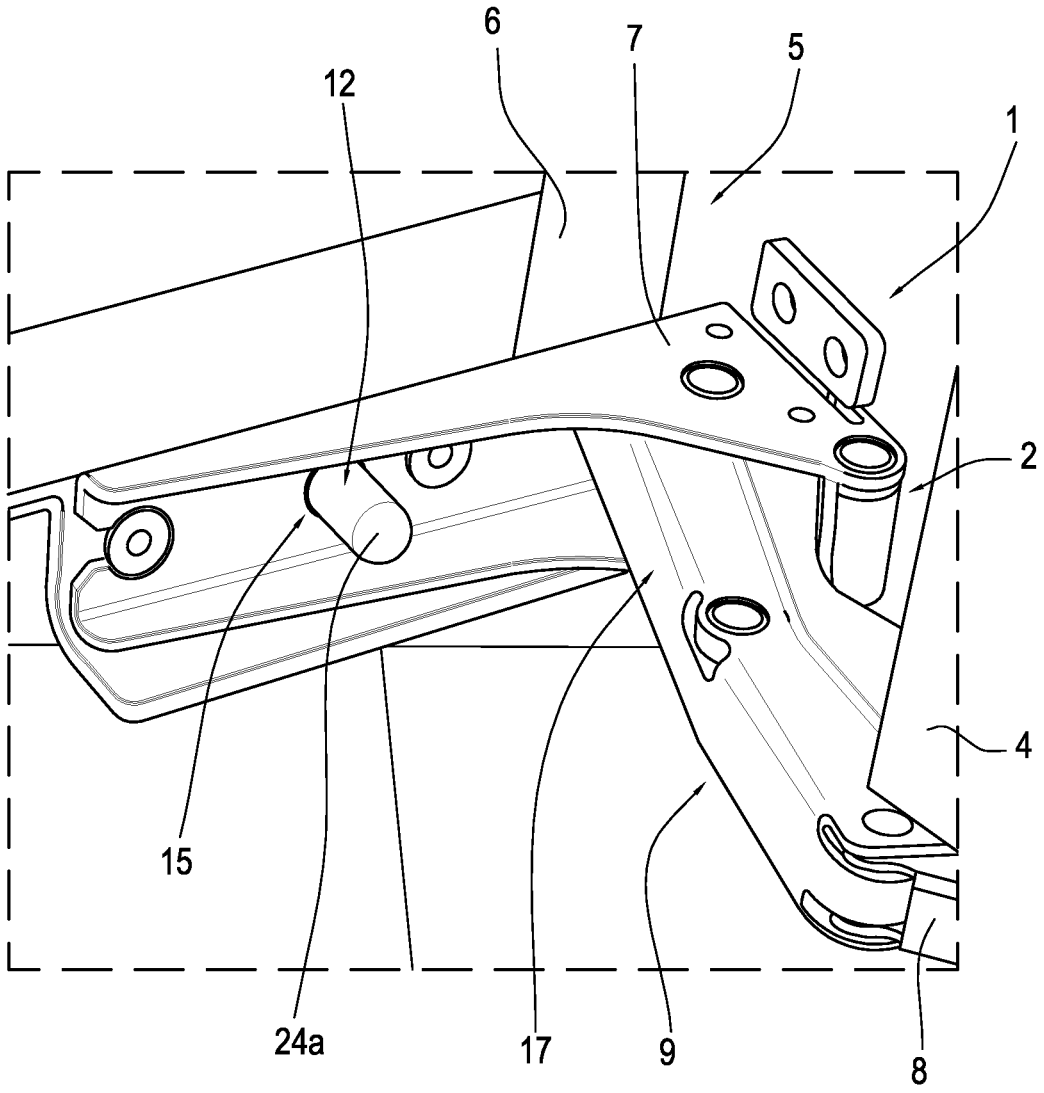
FIG. 4 is a perspective view of a detail of the hinge and damping device of FIG. 1.

Whatever the case, the two fastening arms 7, 8 are reciprocally mobile so that the door 4 can be rotated relative to the frame 6 between a closed position (FIG. 1) and at least one open position (FIG. 4).

The damping device 3 comprises a case or frame 10, housed in the frame 6 of the refrigerator 5, and more specifically, mounted in a corner in the front, bottom or top base of the refrigerator 5.

The case 10 houses a gas- or fluid-driven cylinder and piston unit 11 (of known type) designed to slow down the closing movement of the door 4 to prevent the latter from strongly impacting a sealing strip, not illustrated, on the frame 6.

The cylinder and piston unit 11 operates indirectly on the door 4. In effect, the action of the cylinder and piston unit 11 is applied to the door 4 both through the hinge 2, as explained in more detail below, and through an actuating end-piece 12 which, on one side, acts in conjunction with the hinge 2 and, on the other, is connected to the cylinder and piston unit 11 through a drive unit 13, also housed in the case 10.

More in detail, the hinge 2 is mounted against the case 10 of the damping device 3 on the opposite side of the device 3 with respect to a front wall of the frame 6 and the actuating end-piece 12 is in the form of a substantially cylindrical rod projecting at right angles both through the case 10, towards the outside of the case 10 itself, and towards the inside of the hinge 2 through the first fastening arm 7.

More specifically, the rod 12 projects at right angles through a bushing 14 of the case 10 and through a hole 15 passing through the first fastening arm 7 which is axially aligned with the bushing 14.

Advantageously, the hole 15 may be one of the standard screw fastening holes made in a commercial type hinge 2.

Alternatively, in another embodiment which is not illustrated but easy to infer from the context, the rod 12 projects at right angles through the bushing 14 of the case 10 and through an opening in the first fastening arm 7 aligned with the bushing 14.

Clearly, in both cases, although not illustrated, the frame 6 also has a through hole or opening aligned with the bushing 14 and the hole 15, or with the equivalent opening in the first arm 7 to allow the passage of the rod 12.

The rod 12 is constrained by a guide 16 in the case 10 to move in a straight line between a first extracted position (FIGS. 2 and 4), in which the rod 12 projects freely towards the inside of the hinge 2, and a second retracted position (FIGS. 1 and 3), in which the rod 12 is in contact with a thrust surface 17 of the hinge 2.

The thrust surface 17 is formed by the group of levers 9. Alternatively, if the arms 7 and 8 are hinged to each other directly by means of a cylindrical hinge, the thrust surface 17 might be formed by the second fastening arm 8.

The guide 16 is formed by the assembly of the bushing 14 together with a further bushing 18 provided on a wall 19 inside the case 10. The wall 19 extends squarely from a base wall 31 of the case 10.

Figure 3:
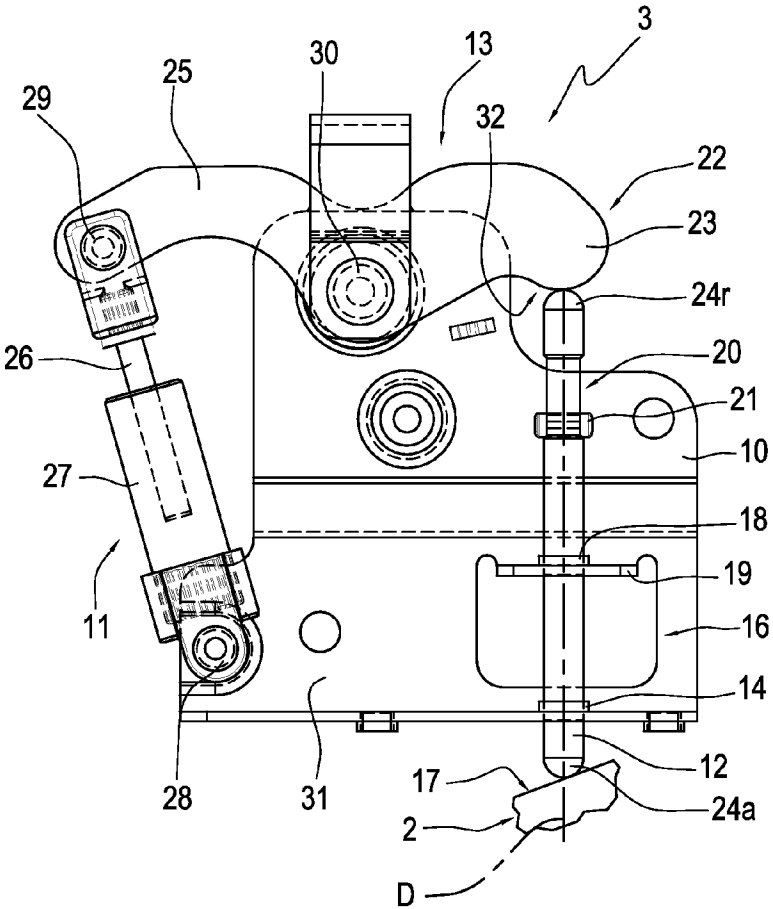
FIGS. 2 and 3 are two plan views of the damping device of FIG. 1 in two different moments in their operation.
Figure 2:
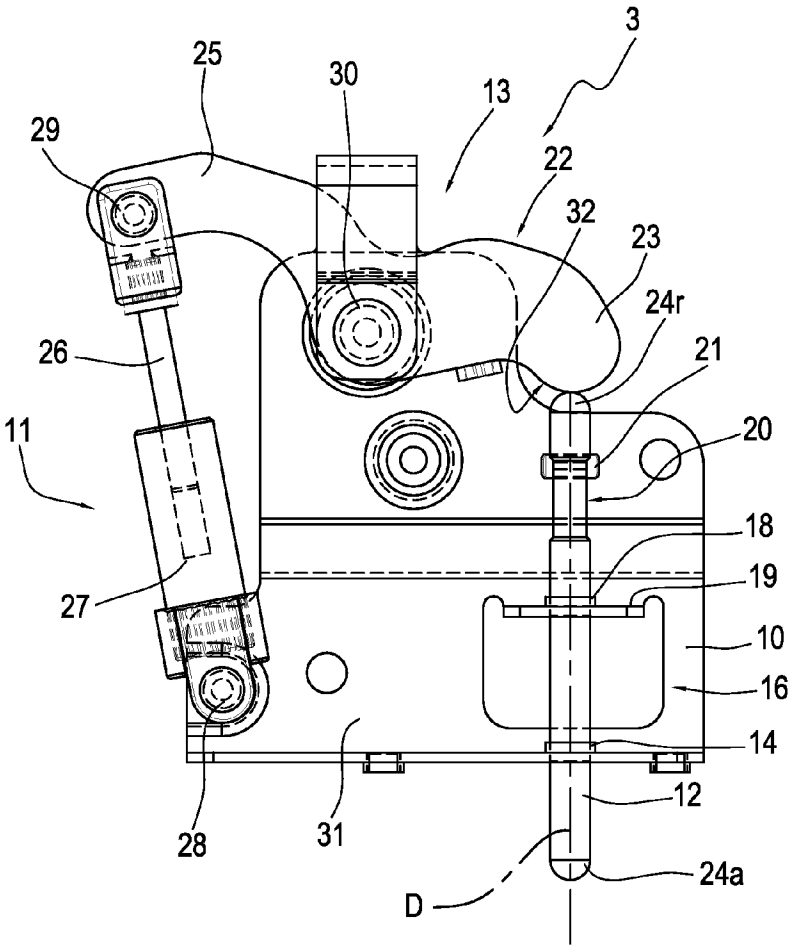

The rod 12 has an annular groove 20 which is coupled to a protrusion 21 on the inside of the wall 31 to constrain the straight-line movement of the rod 12 in both directions, that is to say, away from and towards the inside of the hinge 2 (FIGS. 2 and 3).

The drive unit 13 comprises a rocker 22 which is hinged to the wall 31 by means of a pin 30 and has, on the opposite side of the pin 30, a first arm 23 in contact with one end 24*r* of the rod 12 inside the frame 6 and a second arm 25 hinged to the piston 26 of the unit 11. The cylinder 27 of the unit 11 is in turn hinged to the wall 31 of the mounting case 10.

More in detail, the rotation pins 28, 29 and 30 of the cylinder 27, of the piston 26 and of the rocker 22, respectively, are parallel to each other and at right angles to both the wall 31 and to the direction D of movement of the rod 12.

The first arm 23 of the rocker 22 forms a cam 32 whose shape is such as to vary the slowing action during the closing movement of the door 4, in particular preventing the door 4 from slowing down too much at the end of the closing movement. That ensures the perfect airtightness of the seal (not illustrated) on the frame 6.

It is important to stress that the above mentioned drive unit 13 imparts to the piston 26 a sliding movement without transversal stresses in the cylinder 27. In effect, the unit 11, thanks to the degree of freedom allowed by the pin 28 is stressed axially while at the same time turning about the pin 28. It is also important to stress that, without departing from the spirit of the invention, the pin 28 might hinge the cylinder 27, as described above, but alternatively, in a totally equivalent manner, the piston 26 in a configuration, not illustrated, where the positions of the piston 26 and of the cylinder 27 within the damping device 3 are reversed.

It should also be noted that the rod 12 can be inserted through the hole 15 and into the guide 16 even with the hinge 2 and the rest of the damping device 3 already fitted, thus considerably facilitating final assembly.

Furthermore, owing to its limited cost, the damping device 3 can be provided on both the left and right of the top or bottom base of the refrigerator 5 so it is ready to receive either a hinge for either left- or right-hand opening. Obviously, the rod 12 need not be pre-fitted since, as stressed above, it may be mounted at a later stage, even after the hinge 2 has been installed.

Figure 5:
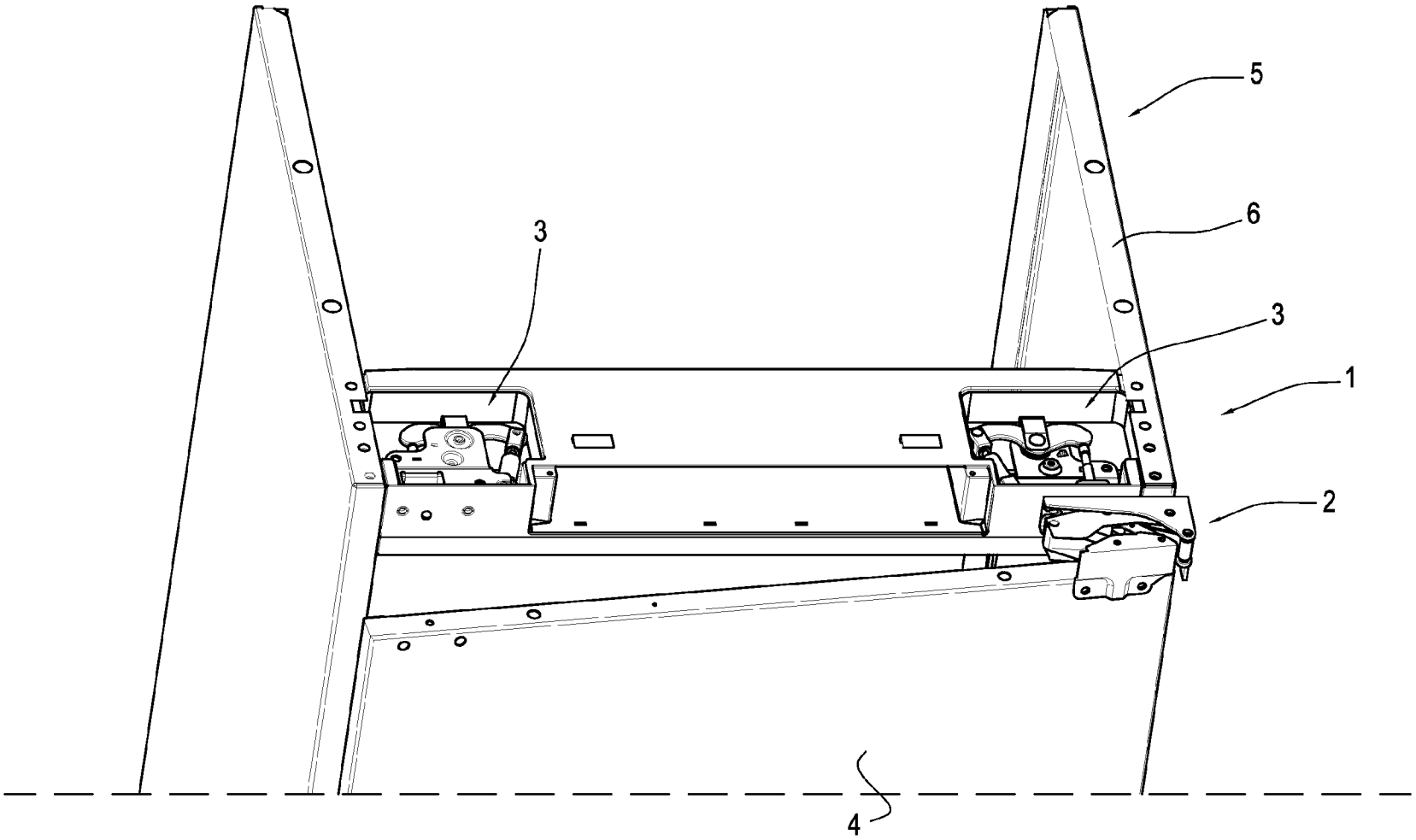
FIG. 5 is a different perspective view of the refrigerator of FIG. 1.

The ready fitting is also facilitated by the fact that the damping device 3 can be mounted reversibly by simply turning it upside down, as shown in FIG. 5.

In other words, the damping device 3 can be mounted with a right-hand opening hinge 2 and, if turned upside down, with a similar left-hand opening hinge 2, too.

Obviously, the damping device 3 can be provided in both the top and the bottom base of the refrigerator 5, on the right-hand and/or the left-hand side. In other words, the refrigerator 5 can be fitted with one, two or four pre-assembled damping devices 3.

In operation, assuming, in the most simple case, that the refrigerator has a single damping device 3, for example at the bottom base of the refrigerator 5, when the door 4 is opened (to more than a certain degree) the end 24*a* of the rod 12, opposite the above mentioned end 24*r*, projects freely towards the inside of the open hinge 2 and the piston 26 is in the extracted position outside the cylinder 27 (FIGS. 2 and 4).

When the door 4 is closed, the thrust surface 17 of the hinge 2 comes into contact with the end 24*a* (FIG. 3) of the rod 12 and pushes the latter in the direction D towards the inside of the damping device 3.

During its straight-line movement, the rod 12 rotates the rocker 22, which in turn axially compresses the piston 26 inside the cylinder 27, thereby applying a slowing action on the door 4.

The invention described herein achieves the above mentioned aims.

In effect, the hinge and damping device combination according to the invention is effective, safe, inexpensive and durable, as well as aesthetically pleasing. Indeed, the only visible part of the damping device 3 is the end 24*a* of the rod 12 which faces the inside of the hinge 2. Moreover, the end 24*a* is contained within the hinge 2 and it is difficult for it to interfere dangerously with the movements of the user.

Also, with the damping device pre-installed on the frame, assembly of the hinge is extremely quick and easy.

Further, the invention described above is susceptible of industrial application and may be modified and adapted in several ways without thereby departing from the scope of the inventive concept. Moreover, all the details of the invention may be substituted by technically equivalent elements.

What is claimed is:

1. A combination hinge and damping device; comprising:

a hinge comprising:

a first fastening element adapted to be mounted to a door a second fastening element adapted to be mounted to a frame a connecting mechanism pivotally interposed between the first and the second fastening elements to make the first and the second fastening elements reciprocally mobile;

a reciprocally mobile thrust surface;

a damping device associated with the hinge at a mounting position where the damping device and the hinge are positioned close to each other, the damping device comprising:

a mounting case;

a gas or fluid cylinder and piston unit having a piston and a cylinder slidably coupled to each other;

an actuating end-piece reciprocally supported by the mounting case for reciprocal movement with respect to the mounting case; and a drive unit interposed between the cylinder and piston unit and the actuating end-piece to impart to the piston and the cylinder a relative sliding movement as the actuating end-piece reciprocates with respect to the mounting case; wherein the drive unit comprises a rocker hinged to the mounting case;

the actuating end-piece being movable along a straight line of motion between a first, extended position, where the actuating end-piece is disengaged from the thrust surface when the hinge is in an open position, and a second, retracted position, where the actuating end-piece is engaged with the thrust surface when the hinge is in a closed position;

the cylinder and piston unit imparting a slowing action on the hinge during a closing movement of the hinge when the thrust surface engages the actuating end-piece and the hinge approaches the closed position;

the piston and cylinder unit being hinged to the mounting case.

2. The combination according to claim 1, wherein the piston and cylinder unit is hinged to the mounting case to rotate about a first pin at a right angle to the straight line of motion of the actuating end-piece.

3. The combination according to claim 2, wherein the rocker is hinged to the mounting case to rotate about a second pin at a right angle to the straight line of motion of the actuating end-piece.

4. The combination according to claim 3, wherein the rocker comprises, on opposite sides of the second pin, a first arm in contact with an inside end of the actuating end-piece and a second arm hinged to the piston; the cylinder being in turn hinged to the case by the first pin.

5. The combination according to claim 4, wherein the first arm forms a cam engaging the actuating end-piece to reduce the slowing action imparted on the hinge at an end of the closing movement.

6. The combination according to claim 5, wherein the actuating end-piece extends into the hinge through the first fastening element.

7. The combination according to claim 6, wherein the actuating end-piece is a rod that extends at a right angle through the first fastening element.

8. The combination according to claim 7, wherein the rod extends through an opening in the first fastening element.

9. The combination according to claim 8, wherein the first fastening element is fixed to the frame and the second fastening element is fixed to the door make the door movable relative to the frame between a closed position and at least one open position.

10. An electrical household appliance, comprising at least one combination according to claim 9 and where the damping device is housed in a frame of the electrical household appliance.

11. The combination according to claim 8, wherein the thrust surface is positioned on the connecting mechanism.

12. The combination according to claim 1, wherein the thrust surface is positioned on the connecting mechanism.

13. The combination according to claim 1, wherein the piston and cylinder unit is also hinged to the rocker such that the straight line of motion of the actuating end-piece is converted to a pivoting motion of the piston and cylinder unit with respect to the mounting case, a pivoting motion of the piston and cylinder unit with respect to the rocker, and the relative sliding movement between the piston and the cylinder.

14. The combination according to claim 1, wherein the first fastening element is fixed to the frame and the second fastening element is fixed to the door to make the door movable relative to the frame between a closed position and at least one open position.

15. An electrical household appliance, comprising at least one combination according to claim 1 and where the damping device is housed in a frame of the electrical household appliance.

16. The combination according to claim 1, wherein the actuating end-piece extends into the hinge through the first fastening element.

17. The combination according to claim 1, wherein the actuating end-piece is a rod that extends at a right angle through the first fastening element.

18. The combination according to claim 17, wherein the rod extends through an opening in the first fastening element.

* * * * *